US005392687A

United States Patent [19]

Shiells

[11] Patent Number: 5,392,687

[45] Date of Patent: Feb. 28, 1995

[54] ARMOR APPLIQUE

[75] Inventor: James E. Shiells, Bel Air, Md.

[73] Assignee: The United States of America as represented by the Secretary of the Army, Washington, D.C.

[21] Appl. No.: 508,641

[22] Filed: Jun. 23, 1983

Related U.S. Application Data

[63] Continuation-in-part of Ser. No. 248,642, Mar. 27, 1981, abandoned.

[51] Int. Cl.[6] ..... F41H 5/007; F41H 7/00

[52] U.S. Cl. ..... 89/36.17; 89/36.08

[58] Field of Search ..... 89/36 AE, 36 B, 36 E, 89/36 H, 36 R, 36.01, 36.03, 36.06, 36.08, 36.17

[56] References Cited

U.S. PATENT DOCUMENTS

| | | | |
|---|---|---|---|
| 408,342 | 8/1889 | Gerard | 211/107 |
| 496,185 | 4/1893 | Bowling | 211/107 |
| 1,112,748 | 10/1914 | Yoran | 89/36 H |
| 1,236,811 | 8/1917 | Zawacki | 89/36 B |

FOREIGN PATENT DOCUMENTS

| | | | |
|---|---|---|---|
| 731282 | 2/1943 | Germany | 89/36 B |
| 1185090 | 1/1965 | Germany | 89/36 B |
| 265430 | 6/1929 | Italy | 89/36 R |
| 2040029 | 8/1980 | United Kingdom . | |

OTHER PUBLICATIONS

TM 9-1910, TO 11A-1-34, Military Explosives, Apr. 1955, p. 49.

*Primary Examiner*—Stephen C. Bentley

*Attorney, Agent, or Firm*—Freda L. Krosnick; Muzio B. Roberto

[57] ABSTRACT

An armor applique for the muzzle end of a gun tube includes a collar which fastens onto the gun tube and which has affixed to its annular surface a number of radially extending circumferentially spaced explosive filled rods which will cause deflection premature functioning of and/or damage to an oncoming warhead. The rods are replaceably affixed to the gun tube by bayonet type connectors.

8 Claims, 6 Drawing Sheets

ARMOR APPLIQUE

The invention described herein may be manufactured, used and licensed by or for the Government for governmental purposes without the payment to me of any royalties thereon.

This application is a continuation-in-part of a prior application, Ser. No. 248,642, filed 27 Mar. 1981, now abandoned, of James E. Shiells for a Gun Mounted Armor Applique.

BACKGROUND OF THE INVENTION

1. Field of the Invention

This invention relates to a device which causes the premature activation/disruption and deflection of a warhead, and more specifically, to an armor applique which causes shaped charge initiation to occur while the warhead is at a standoff distance from the protective armor. This device may also explosively disrupt incoming missiles' direction of attack in order to lessen their effectiveness.

2. Background of the Invention

Armor appliques have been used to lessen the effectiveness of shaped charge warheads, with their basic function being to cause the initiation of the charge to occur at a standoff distance from the main armor.

It has been recognized that inducing the premature detonation of the shaped charge warheads greatly degrades its armor penetration performance by increasing the standoff distance of the warhead from the armor and exaggerating the detrimental effects of the misalignment of material velocities within the shaped charge jet. An increase of the standoff distance by merely 1 or 2 feet has been found to significantly degrade some anti-tank shaped charge warheads.

With the advent of contemporary precision shaped charge designs, it has become necessary to increase the standoff distance in order to seriously degrade their armor penetration performance. Low values of additional standoff can actually enhance the penetrating capability of modern precision warhead designs. Thus, the use of armor appliques such as bar armor has been found to be inadequate to offset the efficiency of modern shaped charge warheads.

Hollow bar armor partially filled with an explosive also has application in defeating both inert armor piercing and shaped charge projectiles. This happens when the projectile-bar armor impact introduces a certain amount of yaw in the flight attitude. The resultant projectile misalignment can greatly reduce the potential of a kinetic energy type projectile for piercing armor.

BRIEF DESCRIPTION OF THE DRAWINGS

The objectives and advantages of the invention will become apparent from the following description of the invention, particularly when read in conjunction with the drawings, wherein.

DESCRIPTION OF THE PREFERRED EMBODIMENTS

Figure 1:
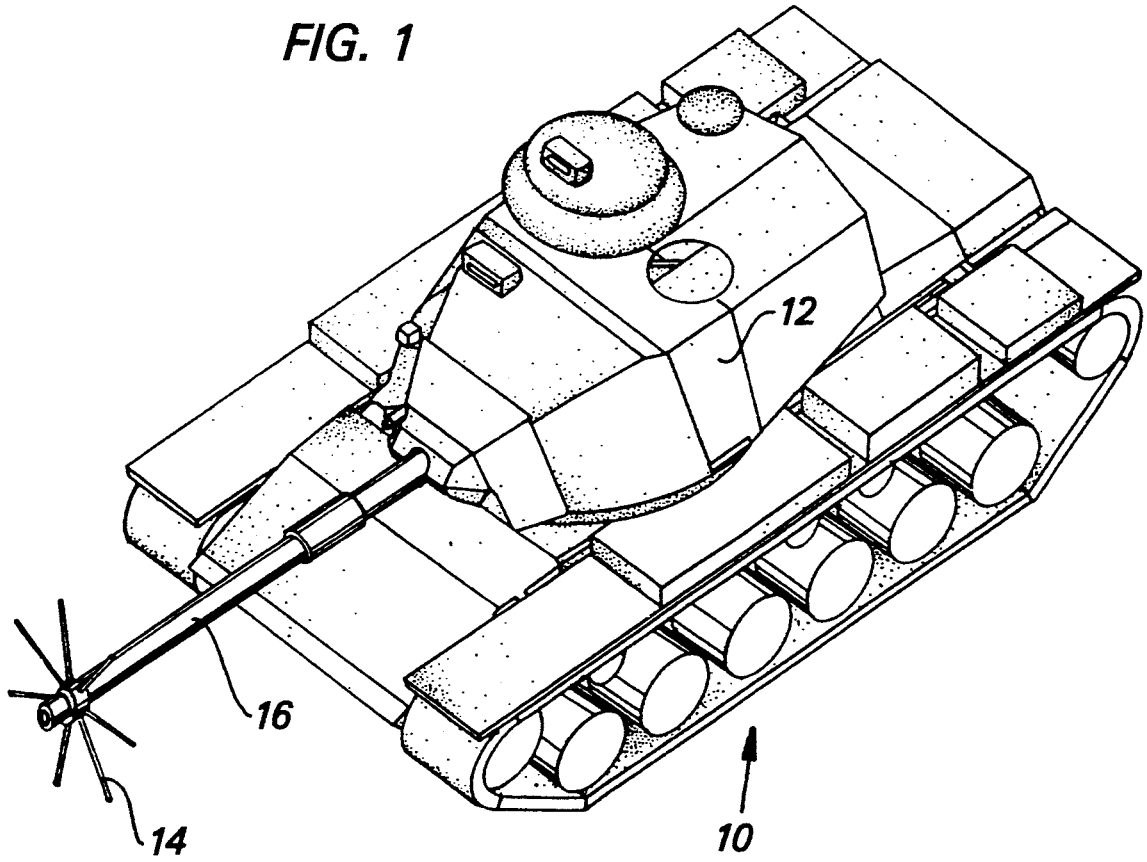
FIG. 1 is a perspective illustration of an armor applique mounted at the muzzle end of the main gun tube of a combat tank.

Referring to FIG. 1, a combat tank 10 carries protective armor 12 to shield the personnel and equipment within the tank from anti-tank missiles. The use against the tank 10 of shaped charge warheads which are capable of penetrating the protective armor 12 has necessitated the use of some means to cause shaped charge initiation to occur at a substantial standoff distance from the armor. In order to maximize the stand-off distance, an applique 214 is mounted at the muzzle end of a gun tube 216.

Figure 2:
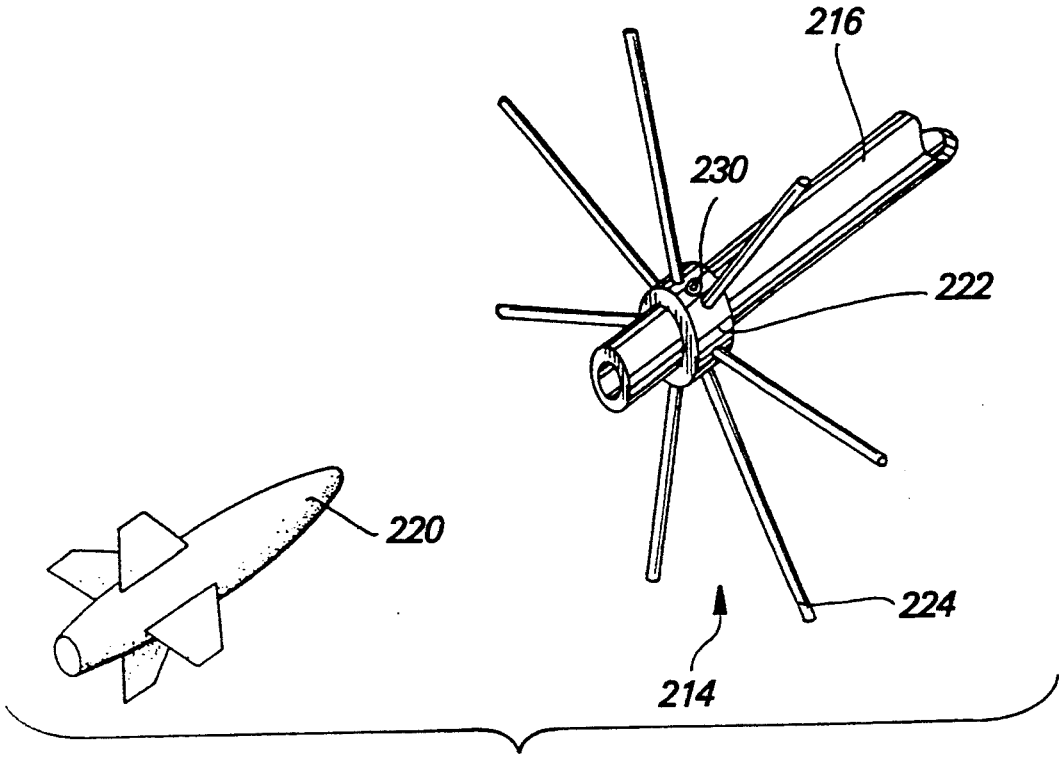
FIG. 2 is an enlarged view of the muzzle end of the main gun tube with the applique intercepting an incoming missile.

Referring to FIG. 2, applique 214 causes an approaching inert kinetic energy type missile to yaw and deflect or a shaped charge warhead 220 to detonate upon contact with the applique, thus producing a drastic reduction in the warhead 220 performance. Under the latter conditions a jet formed by the shaped charge warhead 220 must travel on the order of twelve feet, as in the case of a M60A1 combat tank before impacting the basic armor 12 of the tank 10. In the former case the kinetic energy projectile will lose penetrability. It is evident that the applique 214 when properly positioned on the muzzle end of the main tank gun 216, need not interfere with the gunner's telescope field of view or the functioning of a rangefinder.

When located at the muzzle end of the gun tube 216, there is no interference between the armor applique 214 and the tanks engine deck during periods in which the turret is being traversed.

Figure 3:
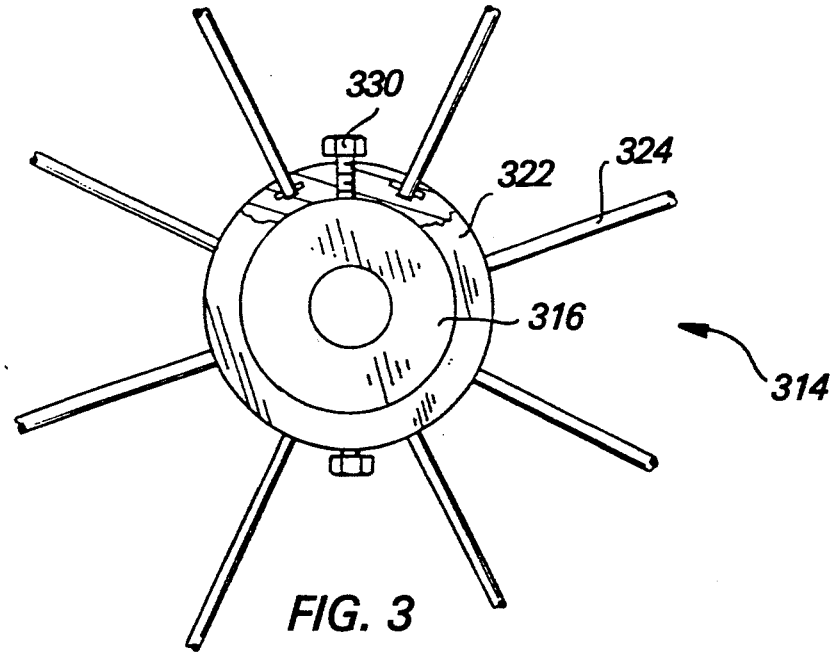
FIG. 3 is a frgamentary front view, partly in section, of the applique of FIG. 1.

As illustrated in FIGS. 2 and 3, a metal ring 322 or hub encircles the gun tube 316 at the muzzle end and is locked in place by any convenient means, such as a screw 330. The metal ring 322 can be slipped into place prior to combat assignment or it can be maintained in place at all times. A plurality of radially spaced rods 324 can be rapidly secured to the ring 322 prior to combat. Rapid and convenient attachment of the rods 324 to the ring 322 can be achieved through the use of a bayonet type connector.

Figure 4:
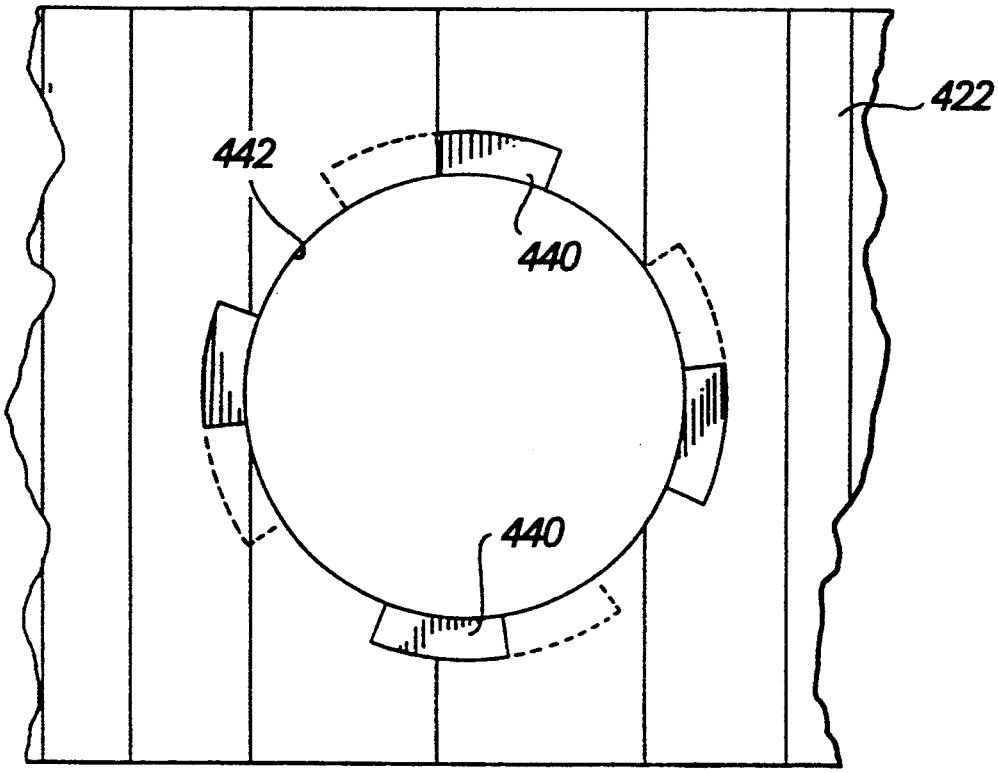
FIG. 4 is a fragmentary top view of a bayonet connector and ring.
Figure 5:
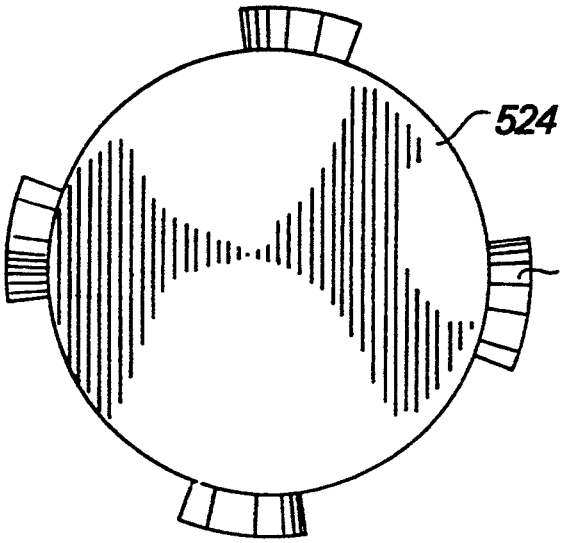
FIG. 5 is an end view of a rod.
Figure 6:
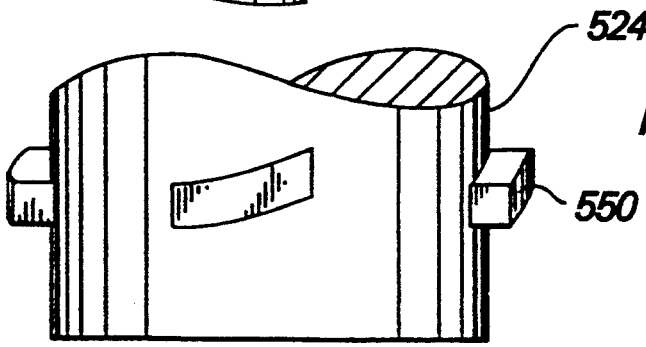
FIG. 6 is a fragmentary side view of the bayonet connection portion of a rod.
Figure 7:
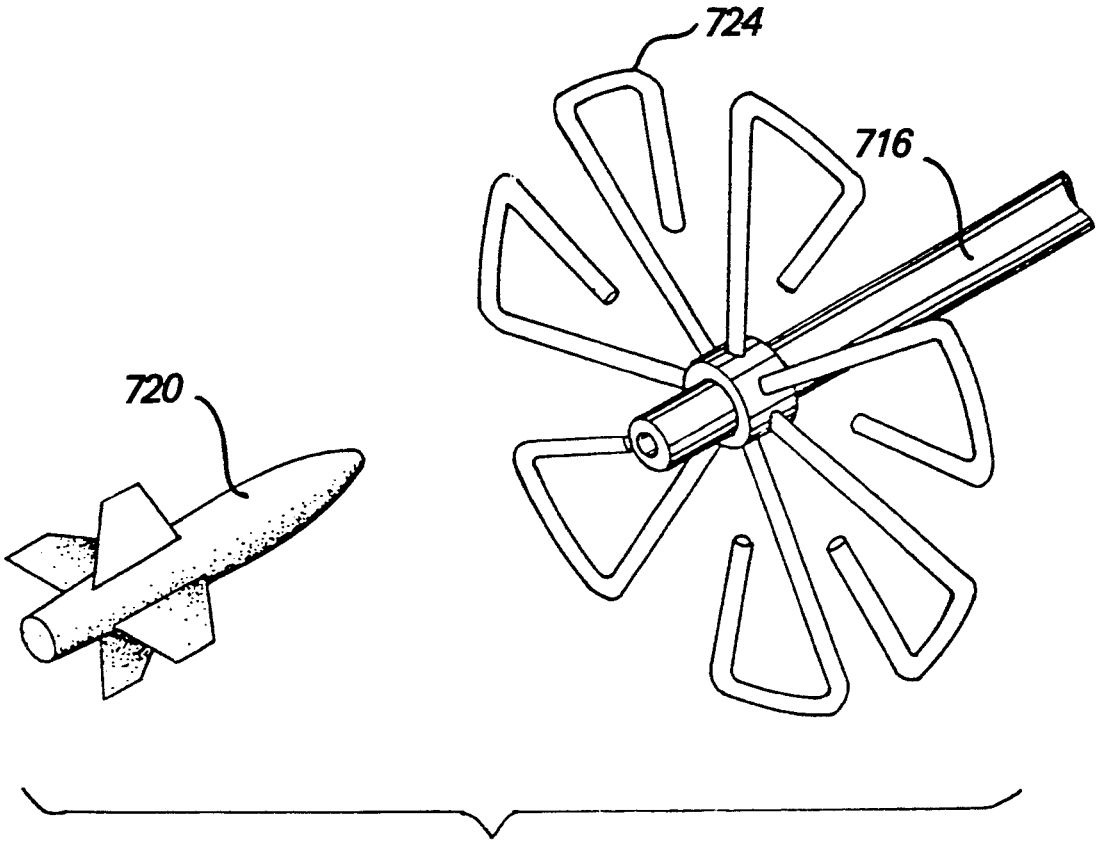
FIG. 7 is an enlarged view of the muzzle end of the main gun tube with an alternative applique design incorporating bent rods.

Referring to FIGS. 4 through 6, ring 422 can be provided with grooves 440 for receiving bayonet tabs 550, included on rods 524 such as shown in FIG. 5. FIG. 6 is a front profile view of FIG. 5. The male bayonet base portion of the rods 524 are slideably inserted into a female portion of the bayonet connection such as shown in FIG. 4 which has a circular recess 442 in the ring 422. Then the rod tabs 550 such as shown in FIG. 5 are aligned with the recess 442 and grooves 440 such as shown in FIG. 4, and the rods 524 rotated until the bayonet connection 550 locks the rods 524 to the ring 22. The rods 24 are preferably constructed about 15 inches long but can be made slightly shorter. Longer rods can be used but care must be taken to prevent interference with turret rotation. Excessive weight and storage problems limit the rod length to about 45 inches. While as few as 2 rods, or as many as 60 rods can be used, the use of 8 rods is preferred. As illustrated in FIG. 7, the rods 724 may be bent in order to more efficiently intercept missiles approaching the periferal region of the applique.

Figure 8:
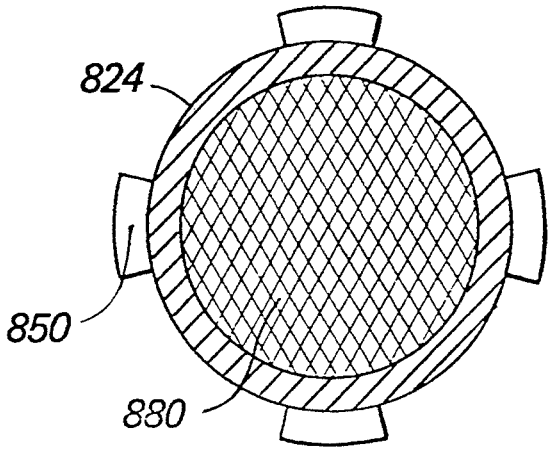
FIG. 8 is a cross-sectional view of an explosive loaded tube.
Figure 9:
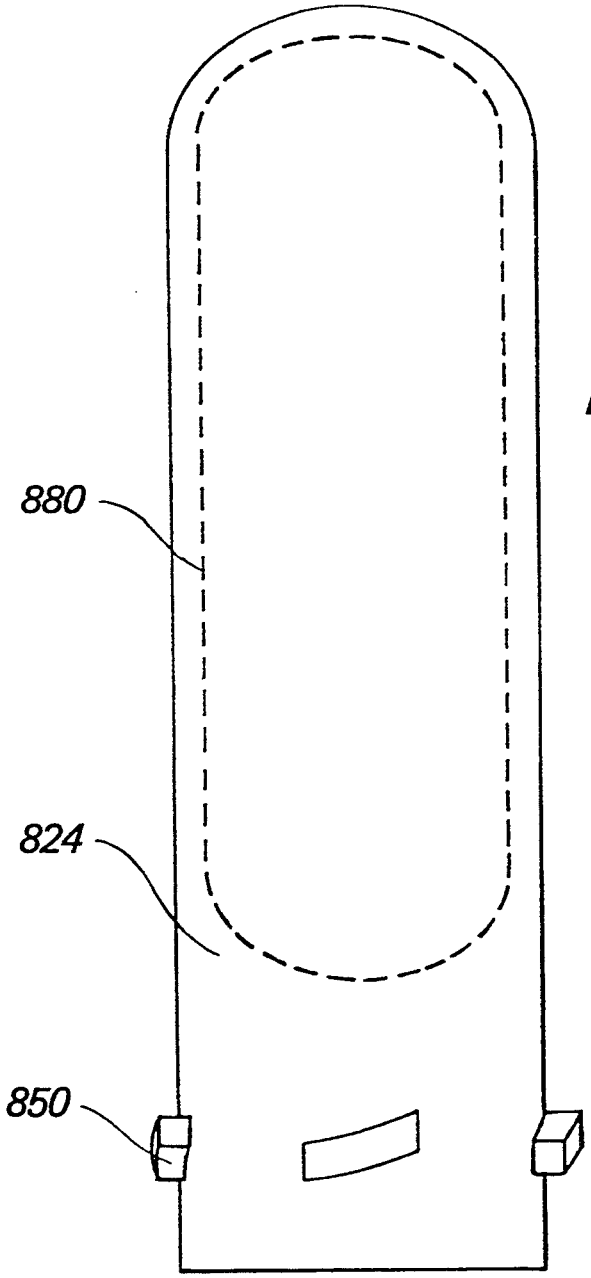
FIG. 9 is a fragmentary side view of an explosive loaded tube.

Referring now to FIGS. 8 and 9 the free ends of the hollow rods 824 are filled with an explosive charge (880). In this embodiment the shock of the projectile impact with the explosive packed end of the tube serves to initiate the explosive in the tube. The ensuing explosive detonation introduces a highly unstabilizing force on both inert and shaped charge projectile. The relatively long subsequent travel distance, of approximately the gun tube length, permits time for a kinetic energy type projectile to develop to an appreciable degree of yaw. This yaw or projectile misalignment can seriously degrade the armor penetrating capability of an armor piercing projectile. The applique configuration described herein is well suited for the explosively expendable elongated rod concept. While a particular rod is destroyed per projectile interaction, the other unexploded rods remain available for said disruptive effect on later incoming projectiles.

Figure 10:
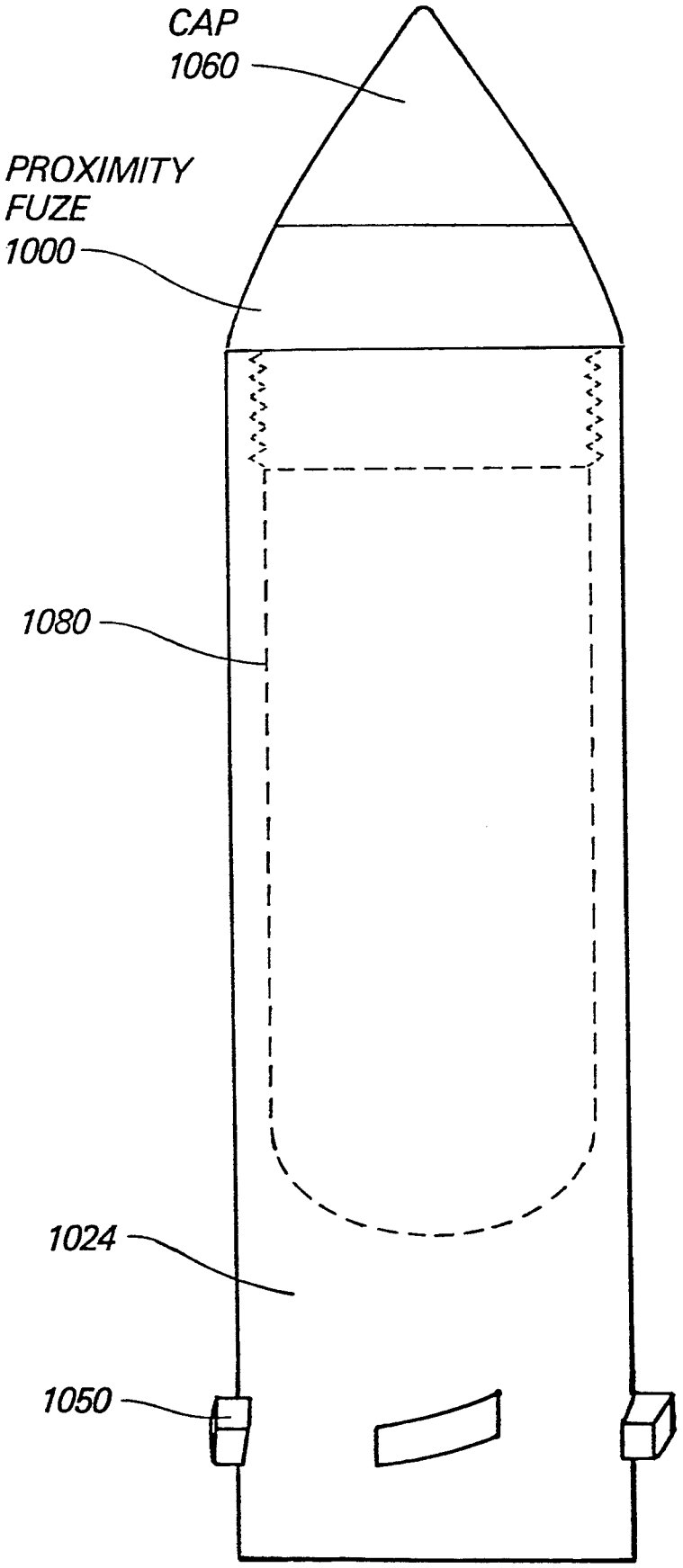
FIG. 10 is a cross-sectional side view of an explosive tube with proximity fuze in place.

Referring now to FIG. 10 the free ends of the hollow rods 1024' are fitted with proximity fuzes 1000. In this best mode embodiment, the inert projectile is detected by the proximity fuze which then detonates the explosive charge 1080. The ensuing explosion results in the same effect as described in the preceding paragraph. It is envisioned that a standard US Army M516A1 proximity fuze, or equivalent, be modified in two ways for optimum performance in this armor applique. The tank crew should be able, at will, to sensitize the proximity fuzes remotely from their positions inside the tank. In addition, the proximity fuzes should be modified to discriminate between massive projectiles as compared with lightweight and ineffective small arms fire. It is expected that the proximity fuzes would be sensitized by the tank crew just prior to the situation of a combat engagement.

In use, referring again to FIGS. 1 and 2 the main gun 16 is aimed toward the hostile firing position, placing the simple lightweight applique 14 between the basic armor 12 of the tank 10 and an incoming missile 220. When an incoming missile 220 strikes an explosive filled hollow rod such as 824 of FIGS. 8, 9, the warhead either functions normally or it is damaged resulting in a low order detonation which has negligible effect on the armor 12. In the case of normal functioning of a shaped charge warhead, there is a long distance, on the order of 12 feet, that the jet must travel before it encounters the main armor of the tank. A distance of this magnitude allows the jet to begin to particulate as a consequence of which, very poor penetration performance is attained.

Since the applique assembly need only weigh about 13 pounds, the rods 224, e.g., can be on the order of 15 inches long and simple threaded and/or bayonet connections or locking mechanisms can be used, thus the applique can be rapidly attached or disconnected and stowed inside the tank vehicle.

It is noted that the applique weight can be less than the heavy muzzle brake used on 90 mm tank guns. The present simple applique design contributes to low manufacturing costs and lends itself to universal adaptability for a retrofit program involving a variety of different tanks.

It would appear that the applique of the present invention provides a relatively small protective area. However, the area of protection afforded by the applique during a frontal attack is very near the center of the tank silhouette. Traditionally, this is coincidental with the aiming point selected by opposing forces. Therefore, a disproportionally large number of incoming rounds may be defeated in the immediate vicinity of the tank's main gun. Approximately 90% of these incoming rounds can be defeated through the use of bar armor applique of the present invention. The potential benefit of this applique is especially apparent during the hull defilade mode of combat operation. In this tactical role, only the turret of the tank is directly exposed to hostile fire. Since this applique largely provides a protected area over the turret, it therefore is more valuable during the condition of hull defilade exposure.

A unitary grid applique (not shown) would be likely to suffer distortion as a result of a warhead blast and could subsequently interfere with the laser rangefinder operation. The applique of the present invention can employ rods which individually break away at their base, thus avoiding the aforenoted problem.

What is claimed is:

1. An armor applique for attachment to the muzzle end of a gun tube to deflect inert type projectiles which comprises:

a single ring member including first locking means for releaseably securing said ring member to said gun tube; and a second means which includes:

a female portion of a bayonet connection peripherally disposed in said ring member; and a plurality of radially spaced explosive filled hollow tubes having free ends mechanically isolated from each other, and bayonet securing means on the other ends for interacting with and releasably retained by said second means; said explosive filled hollow tubes when impacting with said inert projectile cause an explosive detonation which produces an unstabilizing force on said projectile causing it to yaw and to degrade the armor penetrating capability of said projectile.

2. An armor applique of claim 1, wherein said plurality of explosive filled hollow tubes includes a plurality of explosive filled bent hollow tubes operatively spaced from each other to allow only one projectile to interact with one tube, and for leaving the other unexploded tubes available for disruptive effect on later incoming projectiles.

3. The armor applique of claim 1, wherein said second locking means comprises a female portion of a bayonet type connection and said securing means comprises a male portion of said bayonet type connection.

4. The armor applique of claim 1, wherein said plurality of explosive tubes are from 3 to 45 inches in length.

5. The armor applique of claim 1, wherein said plurality of explosive tubes include a plurality of straight tubes which are between 2 and 60 in number.

6. The armor applique of claim 4, wherein said plurality of elongated tubes include a plurality of bent tubes which are between 2 and 60 in number.

7. The armor applique of claim 1, wherein said first locking means includes a threaded screw member which threadedly engages said ring member and is positioned to have one end engage the surface of said muzzle end of said gun tube.

8. An armor applique for attachment to the muzzle end of a gun tube to deflect inert type projectiles which comprises:

a single ring member including first locking means for releasably securing said ring member to said gun tube; second locking means, which includes;

a female portion of a bayone connection peripherally disposed in said ring member; and a plurality of radially spaced explosive filled hollow tubes having free ends fitted with a proximity fuze, and bayonet securing means on the other ends for interacting with and releasably retained by said second means;

said proximity fuze when detecting said inert projectile causes said explosive filled hollow tubes to explode which produces an unstabilizing force on said projectile causing it to yaw and to degrade the armor penetrating capability of said projectile.

* * * * *